US005609276A

United States Patent [19]

Greatbatch

[11] Patent Number: 5,609,276

[45] Date of Patent: Mar. 11, 1997

[54] ADJUSTABLE SPRAY DISPENSING CLOSURE FOR CONTAINERS

[75] Inventor: Keith J. Greatbatch, Crowthorne, Great Britain

[73] Assignee: S. C. Johnson & Son, Inc., Racine, Wis.

[21] Appl. No.: 454,099

[22] PCT Filed: Nov. 30, 1993

[86] PCT No.: PCT/US93/11546

§ 371 Date: Aug. 4, 1995

§ 102(e) Date: Aug. 4, 1995

[87] PCT Pub. No.: WO94/12426

PCT Pub. Date: Jun. 9, 1994

[30] Foreign Application Priority Data

Dec. 2, 1992 [GB] United Kingdom ..... 9225241

[51] Int. Cl.[6] ..... B67D 5/32

[52] U.S. Cl. ..... 222/520; 239/506; 239/507; 239/515

[58] Field of Search ..... 222/519, 520; 239/505–507, 513–515

[56] References Cited

U.S. PATENT DOCUMENTS

| | | | |
|---|---|---|---|
| 182,082 | 9/1876 | Requa | 222/520 |
| 202,714 | 4/1878 | Fox | 222/520 |
| 2,582,026 | 1/1952 | Friedman | 222/520 X |
| 2,759,643 | 8/1956 | Dahlin . | |
| 2,794,581 | 6/1957 | Braun . | |
| 2,829,807 | 4/1958 | Kirschenbaum . | |
| 2,998,170 | 8/1961 | Manzione et al. | 222/520 |
| 3,204,835 | 12/1962 | Michel . | |
| 3,263,851 | 8/1966 | Grimsley . | |
| 3,439,842 | 1/1968 | Stull . | |
| 3,834,596 | 9/1974 | Brady et al. | 222/520 |
| 3,887,116 | 6/1975 | Ishikawa et al. | 222/520 |
| 4,568,004 | 2/1986 | Goncalves | 222/520 X |
| 4,690,304 | 9/1987 | Morel . | |
| 5,402,920 | 4/1995 | Dhillon | 222/519 |
| 5,472,120 | 12/1995 | Stebick et al. | 222/509 X |

FOREIGN PATENT DOCUMENTS

| | | | |
|---|---|---|---|
| 2177385 | 1/1987 | United Kingdom | 222/520 |

*Primary Examiner*—Kevin P. Shaver
*Attorney, Agent, or Firm*—Laura L. Bozek

[57] ABSTRACT

There is disclosed a closure device (1) for attachment to the neck (2) of a container (3). The device has inner (4) and outer (5) coaxial parts movable one relative to the other and each has an exit orifice for the flow of fluid therethrough. The flow of fluid is controlled by one part being movable axially relative to the other part. A control device comprising a frusto-conical valve plug (10) on the outer part controls the flow of fluid from the container so that the movable one of the parts is movable between a closed off condition, an open conical pattern condition, and an open jet stream condition of fluid flow. Accordingly, the user of the closure device has a choice of type of fluid flow to be emitted from the container when the container is squeezed. The inner and outer parts are preferably interconnnected by a quick rise cam arrangement to assist quick separation of the parts.

7 Claims, 3 Drawing Sheets

ADJUSTABLE SPRAY DISPENSING CLOSURE FOR CONTAINERS

TECHNICAL FIELD

The present invention relates to a dispensing closure for containers of the type in which the product contained therein is emitted therefrom under relatively low pressure levels by manually squeezing the container.

BACKGROUND OF THE INVENTION

Such containers as are known have used closure devices in the form of a closing cap which is removed prior to use in the container prior to using the container. However, having to detach a closure cap prior to use or access to the contents of the container is a considerable disadvantage because excess product within the container often builds up within the cap and is forced down the outside surfaces of the container thereby soiling the container and making it inconvenient to hold. Such problems have to a very large extent been overcome by providing such containers with closure devices for enabling use of the product contained within the container without having to remove the closing cap. This has been achieved as disclosed in U.S. Pat. No. 4,690,304 in the name of Simone Morel where the closure cap is movable between a closed position preventing egress of the product and an open position allowing the passage of product from the container.

However, as will be seen from U.S. Pat. No. 4,690,304 many of these devices have a central outlet aperture which is closable by a plug or other closure device such as that shown in U.S. Pat. No. 3,439,842 in the name of M. B. Stull, which discloses a series of outlet apertures arranged in a circle with the outlet apertures fed from a chamber between an outer part of the closure cap and an inner part through which the product is fed into the chamber. The outer cap part has a valve plug comprising a frusto-conical portion attached to an elongate cylindrical portion. The elongate cylindrical portion serves to prevent flow of fluid by engagement in an aperture in the inner part when the closure cap is in its closed position. To obtain flow of fluid a considerable amount of movement of the outer outer part is required towards an open position when the plug disengages the aperture and the frusto-conical portion of the plug is spaced so far from the inner outlet orifice as to be ineffective in controlling fluid flow through the outlet apertures of the closure cap. Therefore, this patent discloses a closure cap which is either in an off-position or an on-position. In the on-position fluid flows from the closure cap in a jet stream.

Such arrangements operate between an off-position and an on-position by a push-pull action, or alternatively by rotating the outer cap part on the inner cap part. However, when dispensing fluids, difficulties arise in ensuring that a stream of fluid issuing from the closure device issues with a correctly shaped stream of fluid. Furthermore, different types of product streams may be required for different applications such as a narrow jet stream and a wider spray. Another difficulty that arises is hardening of the fluid contents around the outlet apertures which subsequently reduces fluid flow. That reduction will then require additional pressure to be applied to the container to emit sufficient amounts of fluid therefrom. This is particularly disadvantageous because people with weak hands will have difficulty in using the container and will turn to another product.

It is an object of this invention to provide a dispensing closure device in which the above mentioned disadvantages are substantially eliminated.

SUMMARY OF THE INVENTION

According to the present invention there is provided a dispensing closure device for a container, the device comprising inner and outer coaxial parts each having an exit orifice for the flow therethrough of the contents of the container, one part being movable axially relative to the other part, and control means being located on one part for controlling the flow of fluid from the container, the movable one of the parts being movable between a closed off condition, an open conical pattern condition, and an open jet stream condition of fluid flow.

The control means is preferably provided on both the inner and outer parts and preferably comprises a frusto-conical valve plug on the outer part and a complementary frusto-conical opening on the inner part wherein engagement between the valve plug and opening at a first location prevents fluid flow, separation to a second location defining a divergent passage therebetween to provide a divergent fluid flow from the output of closure device, and further separation to a third location providing a fluid flow from the output of the closure device wherein opposed sides of the fluid jet stream are substantially parallel.

In one particular embodiment of the invention the inner part of the outer dispensing closure device according to the present invention is preferably mounted upon the neck of a container by a screw thread arrangement.

In an alternative embodiment the inner part is connected to the neck of the container by a snap fit connection.

Preferably, the outer part of the dispensing closure device is screw threadingly engaged to the inner part with such screw thread engagement conveniently being in the form of a quick rise cam or through thread arrangement to assist in speed of opening of the closure device.

In one alternative embodiment of the present invention the inner part of the closure device has a snap fit with the neck of the container to fix the inner part relative to the container and the outer part of the closure device is screw threadingly engaged with the neck of the container.

Conveniently, the inner part of the closure device has a tubular feed member for controlling the flow device of fluid through the inner part. Preferably, the mouth of the outlet orifice of the inner part has an outwardly directed conical surface.

Conveniently, the embodiments of the dispensing closure device have an outer part having a central aperture in which is fixedly mounted a frusto-conical central plug member supported by webs extending radially outward therefrom to the main body of the outer part of the closure device. The plug member has an inwardly tapered frusto-conical surface for making sealing engagement with outwardly extending frusto-conical surface of the outlet orifice of the inner part in the closed position of the closure device.

DETAILED DESCRIPTION OF THE INVENTION

Embodiments of the present invention will now be described by way of example with reference to the accompanying drawings in which.

Figure 1:
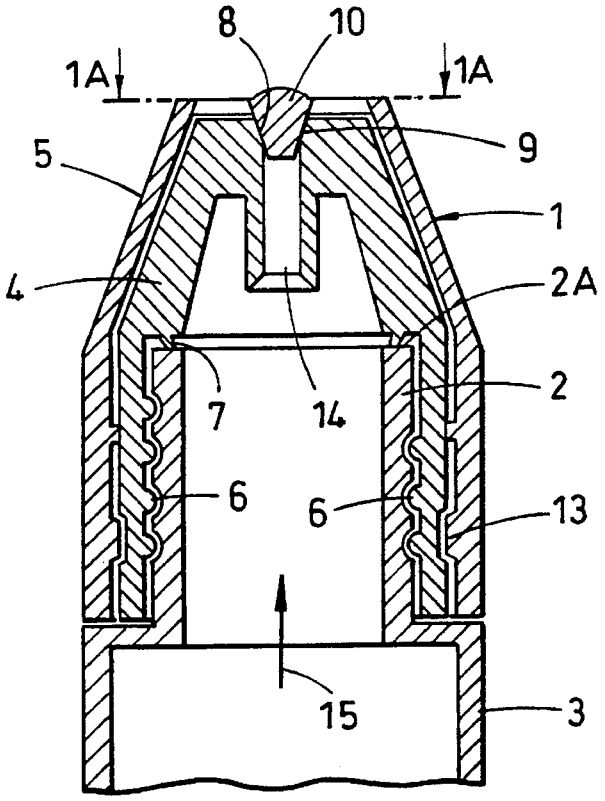
FIG. 1 is a cross-sectional elevational view of a dispensing closure device according to the present invention mounted on a container (shown in partial cross-section with the device in a closed position)
Figure 1A:
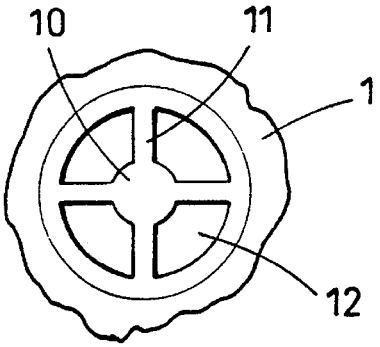
FIG. 1A is a top plan view of FIG. 1 along line 1A—1A only showing the openings at the top of the dispensing closure device.
Figure 2:
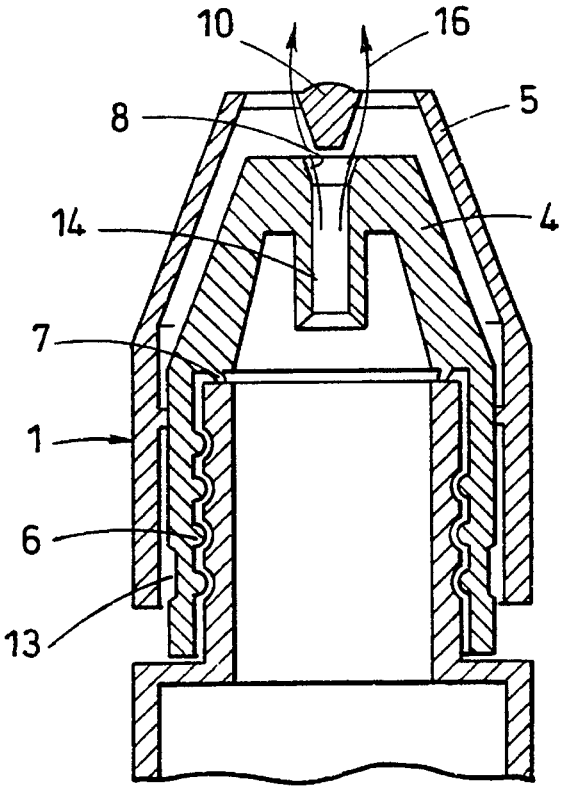
FIG. 2 is a cross-sectional side elevational view of the device of FIG. 1 but illustrated in an open jet stream position.

Referring to FIGS. 1, 1A and 2 of the drawings there is disclosed a dispensing closure device 1 which is mounted on an elongate neck 2 of a container 3.

The dispensing closure device comprises a closure cap 1 having inner and outer tubular mating parts 4, 5 respectively. The inner part 4 is mounted on the neck 2 of the container 3 by a screw-threaded engagement 6 and cannot rotate during operation of the closure cap. An annular seal 7 engages a transverse outermost surface 2A of the neck 2 for sealing the inner part 4 relative to the neck thereby preventing fluid to flow through the screw thread arrangement 6 and soiling the external surface of the container.

The inner part 4 has a central aperture 8 having an inwardly tapered or conical surface 9 at the outlet thereof. The conical surface 9 serves to act as a valve seat for a valve plug 10 which is located centrally at the top in FIGS. 1 and 2 of the outer part 5. The valve plug 10 is supported by a plurality of thin webs 11 which divide the outlet orifice of the outer member 5 into four quadrant shaped apertures 12, FIG. 1A.

The outer part 5 is mounted on the inner part 4 and extends downwardly in FIGS. 1 and 2 over the inner part 4 and is coupled thereto by a screw-thread arrangement 13 which is a conventional quick rise cam thread allowing disengagement of the valve plug 10 from the orifice 8 between its operative positions with the minimum amount of rotation between the outer part 5 and inner part 4 of the closure cap.

The inner part 4 has an elongate tubular extension 14 which extends inwardly from the outlet orifice 8 to allow fluid to flow through the outlet orifice with a regular constant flow pattern to ensure a correct fluid outlet stream from the closure cap.

In operation of the device the inner part 4 is fixed relative to the neck 2 of the container 3 and the outer part 5 is rotated from the closed position shown in FIG. 1 in which fluid within the container, when the container is squeezed manually, will flow in the direction of the arrow 15 through tube 14, outlet orifice 8 and past the plug 10.

Upon rotating the outer part 5 on the inner part 4 the effect of the quick rise thread 13 is to quickly separate the plug 10 from the orifice 8 to allow the flow of fluid in a jet stream as indicated by arrows 16. By selecting an intermediate position in which the valve plug 10 is located close to the conical surfaces 9 of the orifice 8 but is not in engagement therewith, the outwardly tapered passage so formed therebetween ensures that fluid flows through the apertures 12 in a conical type spray pattern.

In other words, when the outer part 5 is rotated on a conventional rising cam or steep thread to a first detent the sealing plug necessarily rises as well. As the container 3 is squeezed, product is forced through the outlet orifice 9 of the inner part 4. The product is deflected outward by the angle of the frusto-conical sealing plug 10 and is dispensed as a cone of product between the supporting webs or arms When the outer part 5 is further rotated to a second detent, the sealing plug rises further. This time it is sufficiently clear of the outer orifice of the inner part so that the product when squeezed from the container will flow around the sealing plug with little or no deflection in a jet of stream.

Referring to the embodiment of FIGS. 3, 4 and 5, the construction of this embodiment is substantially identical to the embodiment disclosed with reference to FIGS. 1 and 2 and accordingly like parts bear the same reference numerals and operate in the same manner as described with reference to FIGS. 1 and 2 therefore requiring no further description in those respects.

However, in this particular embodiment the inner part 4 is provided along its outmost transverse surface 20 with an annular recess 21 extending in a direction parallel to an elongate axis of the closure cap and which receive therein an annular extension 22 extending from the inner surface of the transverse portion 23 of the outer part 5.

The annular extension 22 in the recess 21 has an annular seal 22*a* projecting inwardly of the outer part 5 to engage the wall 21A of the recess 21 to provide a seal to prevent the flow of fluid between the inner and outer parts 4, 5 respectively, and past screw-thread 13 to soil the outer surface of the container.

Figure 3:
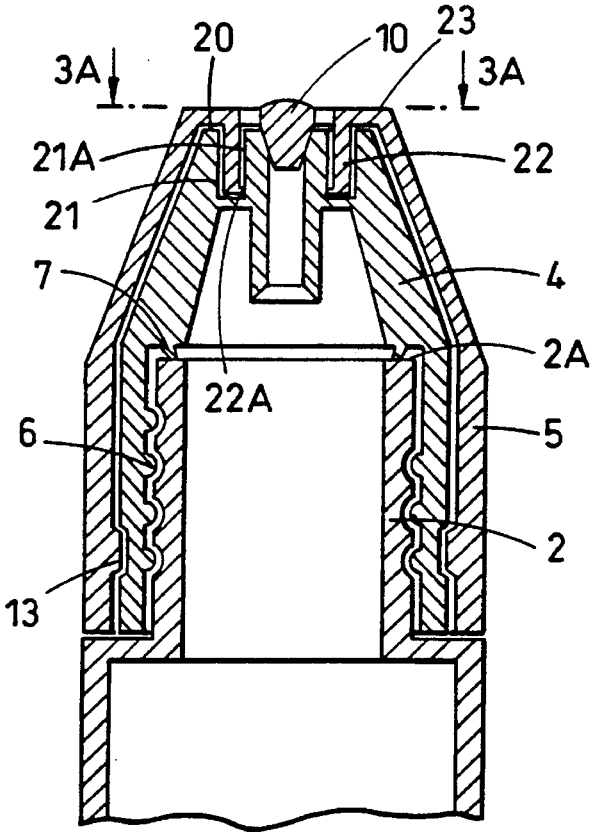
FIG. 3 is a cross-sectional side elevational view of an alternative dispensing closure device according to the present invention in a closed position.
Figure 3A:
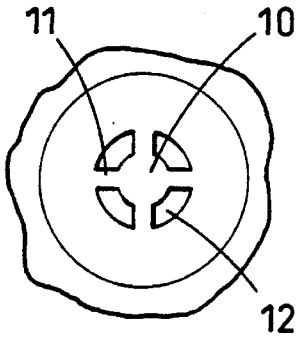
FIG. 3A is a top plan view of FIG. 3 along line 3A—3A only showing the openings at the top of the dispensing closure device.
Figure 4:
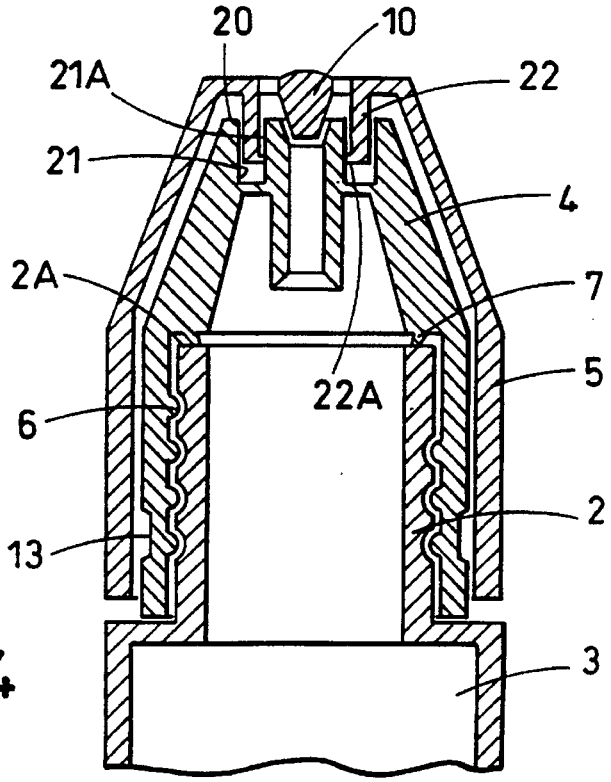
FIGS. 4 and 5 are cross-sectional side elevational views of the device of FIG. 3 with FIG. 4 illustrating a cone spray position of the device and FIG. 5 a jet stream position thereof.
Figure 5:
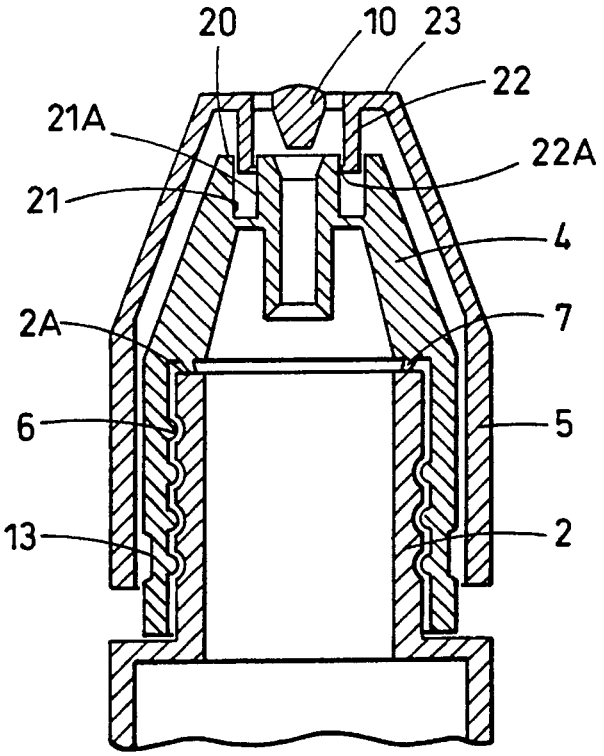

FIGS. 3 and 3A show the dispensing closure cap in a closed position, FIG. 4 shows the cap in a conical spray condition and FIG. 5 shows the cap in a jet stream condition. FIG. 3A shows a different layout for apertures 12, webs 11 and valve plug 10 thereby accommodate the annular extension 22 without fluid passing to the outside of the container.

Figure 6:
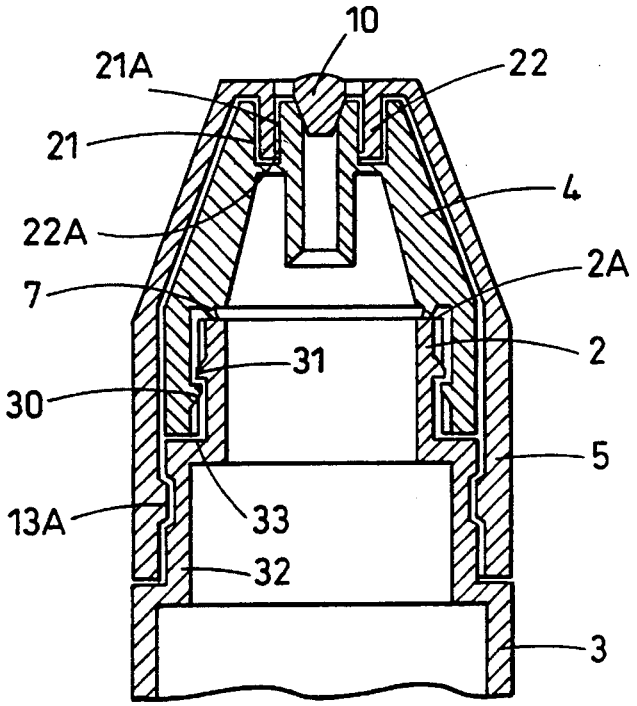
FIG. 6 is a cross-sectional side elevational view of a further dispensing closure device according to the present invention in a closed position of the device.

Referring to the embodiment of FIG. 6, it is substantially identical to the embodiments disclosed with reference to FIGS. 1 and 2, or to FIGS. 3, 4 and 5. Similarly, like parts bear the same reference numerals and the closure device shown operates in exactly the same manner as described with reference to the two earlier embodiments, at least as far as the engagement and disengagement of the valve plug 10 in the outlet orifice 8 of the inner part 4 is concerned.

The difference in the construction disclosed in FIG. 6 lies in that the inner part 4 is constructed to have an inwardly projecting annular ring 30 which has a snap fit engagement with an annular ring 31 on the neck 2 of the container 3 in the outlet region of the container. The outlet part of the neck of the container is in this instance small relative to the remainder of the neck to accommodate the snap fit connection of the inner part 4 with the neck. The neck 2 is therefore provided with an enlarged diameter portion 32 which enables the inner part 4 to overlie a transverse land 33 and allows the outer part 5 to extend downwardly in FIG. 6 beyond the lowermost end of the outer part 4 to overlie the enlarged diameter neck portion 32. A quick rise cam or thread arrangement 13A is provided between the outer part and enlarged diameter neck portion 32 to enable the outer part 5 to be rotated to operate the closure cap in the manner previously described.

The presence of the annular seal 22 has the effect of reducing the radial dimension of the outlet apertures 12 but this does not affect the emission from the outlet because this is in each case determined by the conical surface of the valve plug 10 relative to its valve seat.

Conveniently, any of the described embodiments may be provided with detents, not shown, so that as the outer part 5 of the closure cap 1 is turned to the spray or jet stream positions, or indeed the stop position, a detent provided corresponding to that location acts as a physical stop and if necessary an audible click can accompany engagement of the respective detent to indicate a correctly aligned position.

The two parts of the dispensing closure device are preferably formed by injection moulding with a plastic material.

Although in the embodiments described herein the inner part 4 has a tubular extension 14 to assist in providing a constant fluid flow prior to the fluid passing the conical surface of the valve plug 10, such tubular extension may be omitted without substantially effecting the shape of the fluid flowing from the outlet in any of the selected open positions of the closure cap.

Whilst four quadrant shape apertures 12 have been described in the above embodiments any number of apertures can be utilized, one to four such apertures being preferred. Moreover, when there are a number of such apertures they are arranged in a circular manner about the control axis of the closure cap.

Industrial Applicability

This invention is useful in the field of containers and packaging, and particularly, in the dispensing of consumer package goods.

I claim:

1. A dispensing closure device for a container, the device comprising inner and outer coaxial parts each having an exit orifice for the flow therethrough of the contents of the container, one part being movable axially relative to the other part, and control means being located on one part for controlling the flow of fluid from the container, the control means comprises an inwardly tapering frusto-conical valve plug on the outer part of the (closure cap) device, the movable one of the parts being movable between a closed off (condition) location, (an) a first open (conical pattern) location defining a divergent passage therebetween which provides a divergent fluid flow from the output of the closure device and (an) a second open (jet stream condition of fluid flow) location wherein fluid flow from the output of the closure device has opposed sides which are substantially parallel.

2. A device as claimed in claim 1, wherein the control means comprises a flusto-conical surface on the outer side of the exit orifice of the inner part.

3. A device as claimed in claim 1, wherein the inner part of the dispensing closure device has a screw thread for mounting the inner part on the neck of a container by screw threaded interengagement therewith.

4. A device as claimed in claim 1, wherein the inner part has a snap fit connection means for connecting the inner part to the neck of the container.

5. A device as claimed in claim 1, wherein the outer part of the dispensing closure device has means for engagement with screw thread of the inner part.

6. A device as claimed in claim 5, wherein the (screw thread) means for engagement of the outer part to the screw thread inner part comprises a quick rise cam arrangement to assist in speed of opening of the closure device.

7. A device as claimed in claim 1, wherein the outer part of the closure device is screw threadingly engaged with the neck of the container.

* * * * *